US009961445B2

(12) United States Patent
Iijima

(10) Patent No.: US 9,961,445 B2
(45) Date of Patent: May 1, 2018

(54) MICROPHONE UNIT FOR STEREO RECORDING

(71) Applicant: ZOOM CORPORATION, Tokyo (JP)

(72) Inventor: Masahiro Iijima, Tokyo (JP)

(73) Assignee: ZOOM CORPORATION, Tokyo (JP)

( * ) Notice: Subject to any disclaimer, the term of this patent is extended or adjusted under 35 U.S.C. 154(b) by 54 days.

(21) Appl. No.: 15/280,103

(22) Filed: Sep. 29, 2016

(65) Prior Publication Data

US 2017/0099545 A1 Apr. 6, 2017

(30) Foreign Application Priority Data

Oct. 2, 2015 (JP) ..... 2015-197019

(51) Int. Cl.
*H04R 5/027* (2006.01)
*H04R 1/32* (2006.01)

(52) U.S. Cl.
CPC ..... *H04R 5/027* (2013.01); *H04R 1/326* (2013.01)

(58) Field of Classification Search
CPC . H04R 1/02; H04R 1/32; H04R 1/326; H04R 1/40; H04R 1/406; H04R 3/00; H04R 3/005; H04R 5/027; H04R 2499/11; H04S 2400/15
See application file for complete search history.

(56) References Cited

U.S. PATENT DOCUMENTS

2008/0310649 A1 12/2008 Yamada
2010/0008511 A1* 1/2010 Kawano ..... H04R 5/027 381/26
2015/0078555 A1* 3/2015 Zhang ..... H04M 1/035 381/26

FOREIGN PATENT DOCUMENTS

JP 04175099 A * 6/1992
JP 2007214914 A * 8/2007
JP 2008311802 A 12/2008
JP 2009171249 A 7/2009
JP 2011086981 A * 4/2011
JP 2011114623 A 6/2011
JP 2012054742 A 3/2012
KR 20040107149 A * 12/2004 ..... H04R 1/406

* cited by examiner

*Primary Examiner* — Mark Fischer
(74) *Attorney, Agent, or Firm* — The Webb Law Firm

(57) ABSTRACT

A microphone unit for stereo recording capable of switching an arrangement of left and right microphones between a true XY technique and another technique. A microphone unit for stereo recording, including: a pair of unidirectional left and right microphones; and a retractable mechanism joined to the respective left and right microphones. The retractable mechanism is configured—to allow change in a horizontal angle and a vertical position of each of the left and right microphones.

6 Claims, 7 Drawing Sheets

1
10
10A
20
20A
41
42
100
101
101a
102
103
104
104a
104b
104c
105
105a
105b
105c
105d 1
10
10A
20
20A
31
32
41
42
100
101
101a
102
103
104
104a
104b
104c
105
105a
105b
105c
105d 1
10
10A
20
20A
31
32
41
42
100
101
101a
102
103
104
104a
104b
104c
105
105a
105b
105c
105d

MICROPHONE UNIT FOR STEREO RECORDING

CROSS-REFERENCE TO RELATED APPLICATION

This application claims priority to Japanese Patent Application No. 2015-197019 filed Oct. 2, 2015, the disclosure of which is hereby incorporated in its entirety by reference.

BACKGROUND OF THE INVENTION

Field of the Invention

The present invention relates to a microphone unit for stereo recording applicable to a video recorder, an audio recorder, an external microphone, or the like.

Description of the Related Art

General devices, such as a video recorder, an audio recorder, or an external microphone, are provided with a pair of left and right microphones to record a sound source in stereo. The left and right microphones are placed in an arrangement suitable for stereo recording. For example, known arrangements of left and right microphones are in a V shape, in an inverted V shape, and in parallel. Among them, the inverted V shaped arrangement is called as an XY technique. In the XY technique, the sound pickup axes of the left and right microphones intersect with each other. The XY technique is excellent in localized expression of recorded sound in comparison with other arrangements. That is, according to the XY technique, sound arrangement is expressed, in addition to the left and right directions, in the near and far direction. Moreover, the XY technique is excellent in recording of sound from the front.

Conventionally, recording devices have been proposed that allow change in the arrangement of left and right microphones. For example, Patent Documents 1 through 4 listed below disclose audio recorders that allow change in the arrangement of left and right microphones to any of a V shape, an inverted V shape, and parallel.

PRIOR ART DOCUMENTS

Patent Document

Patent Document 1: Japanese Patent Application Kokai Publication No. 2012-54742

Patent Document 2: Japanese Patent Application Kokai Publication No. 2011-114623

Patent Document 3: Japanese Patent Application Kokai Publication No. 2009-171249

Patent Document 4: Japanese Patent Application Kokai Publication No. 2008-311802

SUMMARY OF THE INVENTION

First Problem

All the conventional recording devices described above have a problem of low recording quality in an inverted V shaped arrangement of left and right microphones. As described in Patent Documents 1 through 4, conventional recording devices have a structure only to arrange left and right microphones in an inverted V shape on the same plane and thus they are not capable of achieving high recording quality in the XY technique. To achieve high recording quality in the XY technique, firstly, the left and right microphones have to be arranged in vertically different positions, and secondly, the left and right microphones have to be arranged to overlap vertically. The inverted V shaped arrangement in the conventional recording devices lacks in two structures necessary for the XY technique and cannot be a true XY technique arrangement in the strict sense. In the conventional inverted V shaped arrangement, therefore, the arrangement in the near and far direction of the recorded sound is not expressed sufficiently. In addition, the conventional inverted V shaped arrangement is not capable of sufficiently recording sound from the front. In other words, the conventional recording devices are not capable of taking advantage of the XY technique.

Second Problem

The present applicant manufactures and sells video recorders that allow left and right microphones to be stored in a housing. Such video recorder is distributed on the market under the trade name of "Q4". In the "Q4" of the present applicant, left and right microphones are in an extended state while recording and the left and right microphones are in a stored state while not recording. The left and right microphones of "Q4" are arranged in an inverted V shape and arranged in vertically different positions. The left and right microphones of "Q4" in the extended state are in the true XY technique arrangement to obtain high recording quality. However, the left and right microphones in the stored state are not in any of the arrangement in a V shape, in an inverted V shape, and in parallel and have a problem of decrease in recording quality. Therefore, when a user fails an operation of extending the left and right microphones and recording is performed remaining in the stored state, recording quality decreases.

It is an object of the present invention to provide a microphone unit for stereo recording that exhibit the following technical effects:

- an arrangement of left and right microphones is switchable between a true XY technique and another technique;
- high recording quality is obtained when the left and right microphones are arranged in a true XY technique; and
- good recording quality is obtained even when the left and right microphones are stored in a housing.

(1) To achieve the above objects, a microphone unit for stereo recording of the present invention includes:

- a pair of unidirectional left and right microphones; and
- a retractable mechanism joined to the respective left and right microphones, wherein
- the retractable mechanism is configured
  - to allow change in a horizontal angle and a vertical position of each of the left and right microphones,
  - when the horizontal angle of the left and right microphones reaches an angle of sound pickup axes of the microphones intersecting with each other, to differentiate the vertical positions of the left and right microphones and thus to arrange at least part of the left and right microphones in vertical overlap, and
  - when the horizontal angle of the left and right microphones reaches an angle of the sound pickup axes not intersecting with each other, to equalize the vertical positions of the left and right microphones.

It is preferred that, in the microphone unit for stereo recording according to (1) above, when at least part of the left and right microphones is arranged in vertical overlap, sound pickup surfaces of the left and right microphones intersect with each other on a same vertical axial line.

It is preferred that, in the microphone unit for stereo recording according to (1) or (2) above, an angle between the respective intersecting sound pickup axes ranges approximately from 90° to 135°.

It is preferred that, in the microphone unit for stereo recording according to any one of (1) through (3) above, when a vertical reference position is assumed, a case where the vertical positions of the left and right microphones are in the reference position is defined as a stored state, and a case where the vertical positions of the left and right microphones are above the reference position is defined as an extended state, the retractable mechanism is configured to equalize the vertical positions of the left and right microphones in the stored state and to differentiate the vertical positions of the left and right microphones in the extended state.

It is preferred that, in the microphone unit for stereo recording according to any one of (1) through (4) above, the retractable mechanism includes:

a pair of shafts joined to the respective left and right microphones and extending vertically;

a pair of guide grooves placed in a wall of each shaft or a wall of another member surrounding each shaft; and a pair of guide projections locked in the respective guide grooves, and at least part of the guide grooves is configured to be inclined for interconversion between rotation and vertical motion of the shaft.

It is preferred that, in the microphone unit for stereo recording according to (5) above, the retractable mechanism further includes a lifting mechanism, causing vertical motion of at least each shaft.

The microphone unit for stereo recording of the present invention exhibits the following technical effects.

Firstly, the retractable mechanism enables switching of an arrangement of left and right microphones between a true XY technique and another technique. That is, when a horizontal angle between the left and right microphones reaches an angle of sound pickup axes of the microphones intersecting with each other, the retractable mechanism differentiates vertical positions of the left and right microphones. At this point, at least part of the left and right microphones is arranged in vertical overlap. The arrangement of the left and right microphones is thus in a true XY technique. Meanwhile, when a horizontal angle between the left and right microphones reaches an angle of the sound pickup axes not intersecting with each other, the retractable mechanism equalizes the vertical positions of the left and right microphones. At this point, the left and right microphones are arranged in a V shape or in parallel, thereby achieving an arrangement in another technique other than the XY technique.

Secondly, when the left and right microphones are arranged in a true XY technique, they provide high recording quality. That is, when the left and right microphones are in a true XY technique arrangement, they are arranged in different vertical positions and in vertical overlap at least in part. The arrangement of recorded sound is thus expressed, in addition to in left and right directions, in a near and far direction as well. In addition, such arrangement allows good recording of sound from the front.

Thirdly, even when the left and right microphones are stored in a housing, they provide good recording quality. That is, when the left and right microphones are in a state of being extended from the housing, they are in a true XY technique arrangement. Meanwhile, when the left and right microphones are in a state of being stored in the housing, they are in another technique arrangement. Accordingly, the left and right microphones provide good recording quality based on different techniques in both the stored state and the extended state.

DESCRIPTION OF THE PREFERRED EMBODIMENTS

Figures 1A, 1B, 1C, 1D:
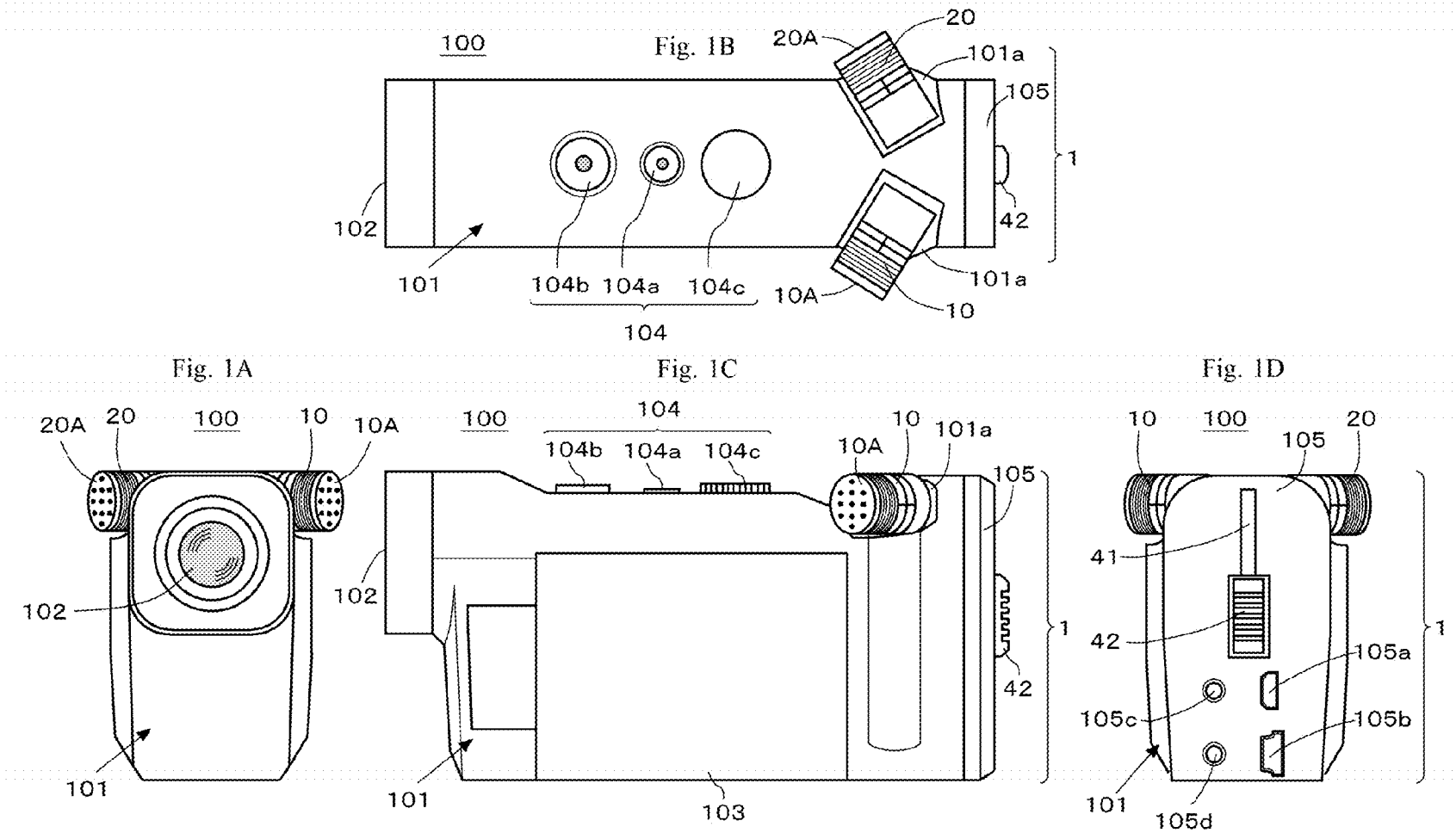
FIG. 1A is a front view of a stored state of left and right microphones.
FIG. 1B is a plan view of a stored state of left and right microphones.
FIG. 1C is a right side view of a stored state of left and right microphones.
FIG. 1D is a rear view of a stored state of left and right microphones.
Figures 2A, 2B, 2C, 2D:
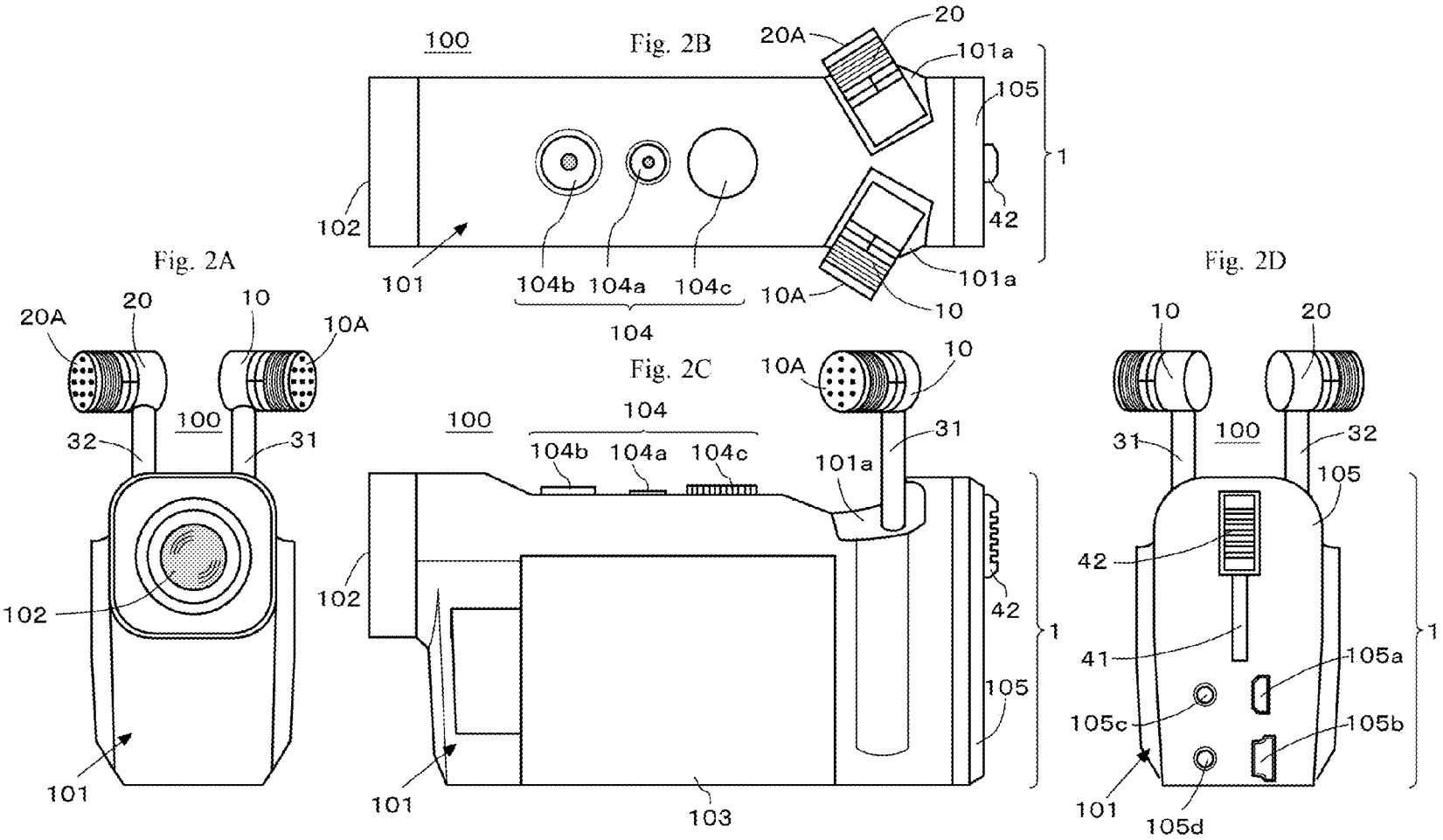
FIG. 2A is a front view of a first extended state of the left and right microphones.
FIG. 2B is a plan view of a first extended state of the left and right microphones.
FIG. 2C is a right side view of a first extended state of the left and right microphones.
FIG. 2D is a rear view of a first extended state of the left and right microphones.
Figures 3A, 3B, 3C, 3D:
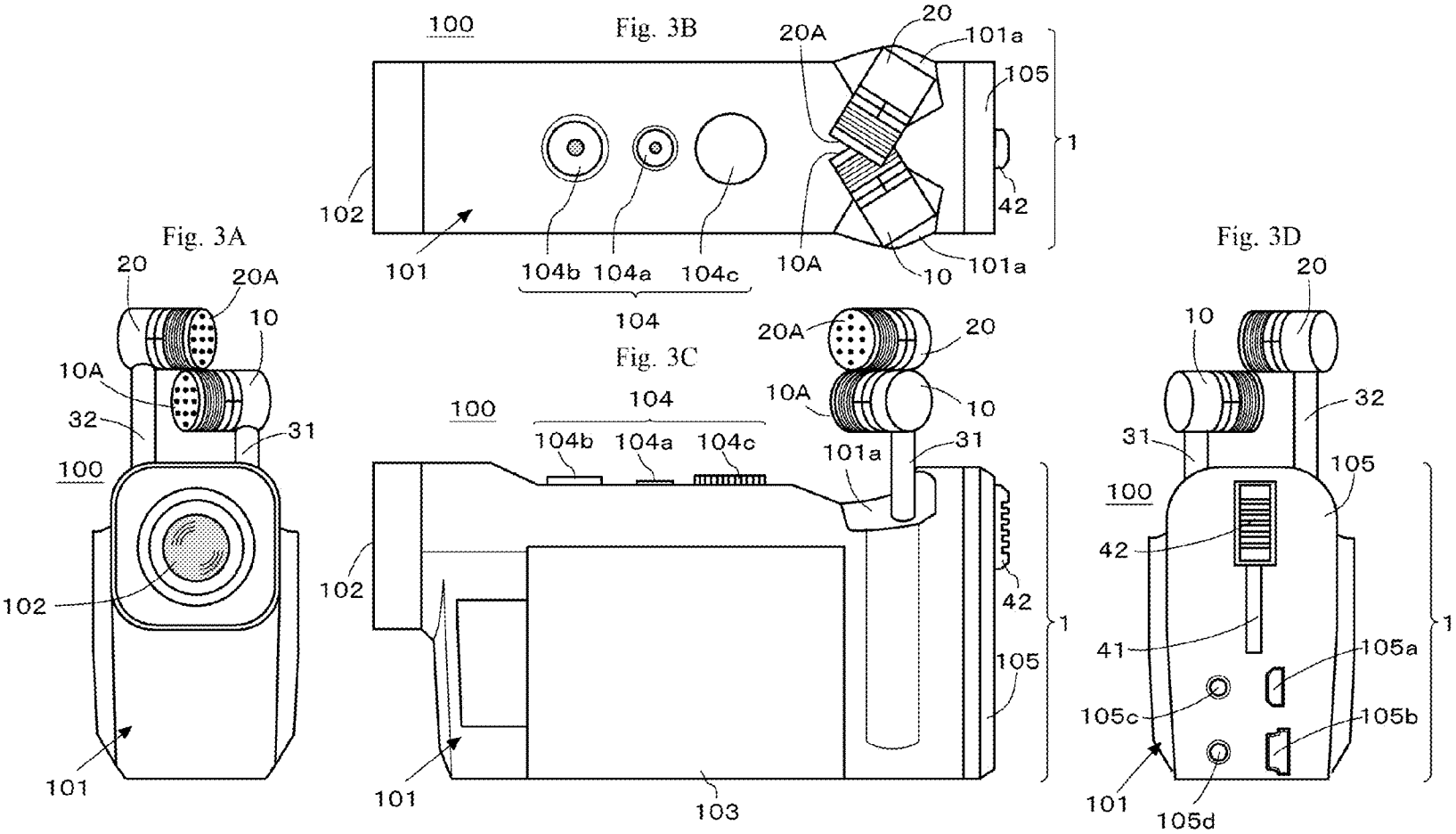
FIG. 3A is a front view of a second extended state of the left and right microphones.
FIG. 3B is a plan view of a second extended state of the left and right microphones.
FIG. 3C is a right side view of a second extended state of the left and right microphones.
FIG. 3D is a rear view of a second extended state of the left and right microphones.

Descriptions are given below to a video recorder provided with a microphone unit for stereo recording according to an embodiment of the present invention with reference to the drawings.

The present invention is not limited to configuration of embodiments described below. For example, a microphone unit for stereo recording of the present invention is not limited to a video recorder and is applicable to an audio recorder and an external microphone. In the descriptions below, a microphone unit for stereo recording is abbreviated simply as "a microphone unit".

Entire Configuration of Video Recorder

As illustrated in FIGS. 1A through 1D, a video recorder 100 in the present embodiment has a housing 101 as compact as fitting in a hand. In a front side of the housing 101, a lens 102 to take an image is placed. On a right side of the housing 101, a display unit 103 configured at variable angles is mounted. On an upper surface of the housing 101, an operation unit 104 is placed. The operation unit 104 includes, for example, a power switch 104*a*, an image recording switch 104*b*, and an input volume dial 104*c*. In a rear surface of the housing 101, a plurality of terminal holes are arranged. Examples of the terminal holes necessary for the video recorder 100 include an HDMI terminal hole 105*a*, a USB terminal hole 105*b*, an external input terminal hole 105*c*, and a headphone terminal hole 105*d*.

In the rear of the housing 101, a microphone unit 1 in the present embodiment is placed. The microphone unit 1 is provided with a left microphone 10 and a right microphone 20. Front surfaces of the left and right microphones 10, 20 are sound pickup surfaces 10A, 20A having a large number of holes formed therein. Inside the microphone unit 1, a retractable mechanism 30 and a lifting mechanism 40 (refer to FIGS. 6A-7D) described later are placed. The left and right microphones 10, 20 have a retractable structure relative to the upper surface of the housing 101 by the retractable mechanism 30 and the lifting mechanism 40. That is, the left and right microphones 10, 20 are in a stored state or an extended state relative to the upper surface of the housing 101.

In this context, the terms "a stored state" and "an extended state" in the present embodiment are defined with reference to the upper surface of the housing 101. The stored state means a state where vertical positions of the left and right microphones 10, 20 are at the upper surface of the housing 101. Meanwhile, the extended state means a state where the vertical positions of the left and right microphones 10, 20 are above the upper surface of the housing 101. The upper surface of the housing 101 includes recesses 101*a*, 101*a* described later. The microphone unit 1 in the present embodiment is capable of having the left and right microphones 10, 20 in three modes of the stored state, a first extended state, and a second extended state.

Stored State

Figure 5A:
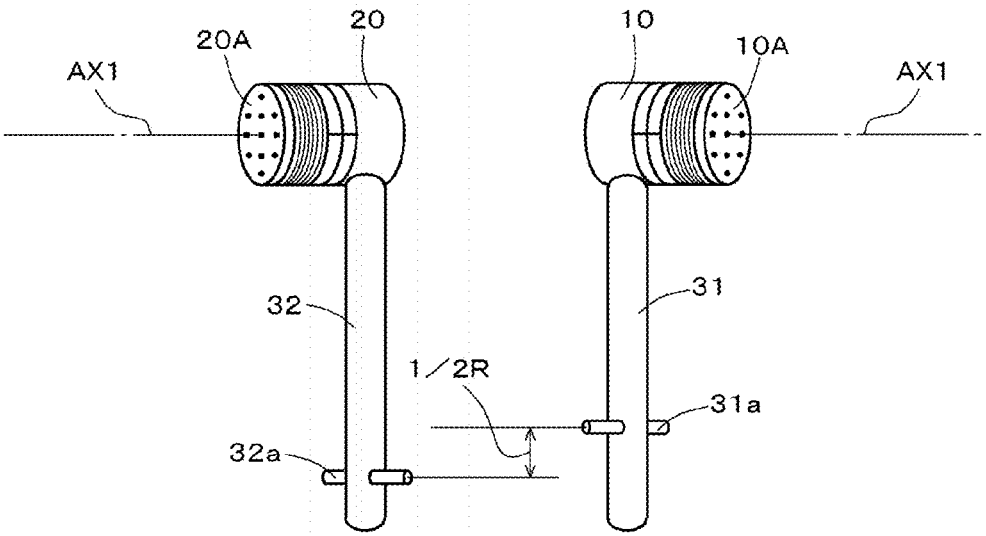
FIG. 5A is a perspective view illustrating the left and right microphones and a shaft.
Figure 5B:
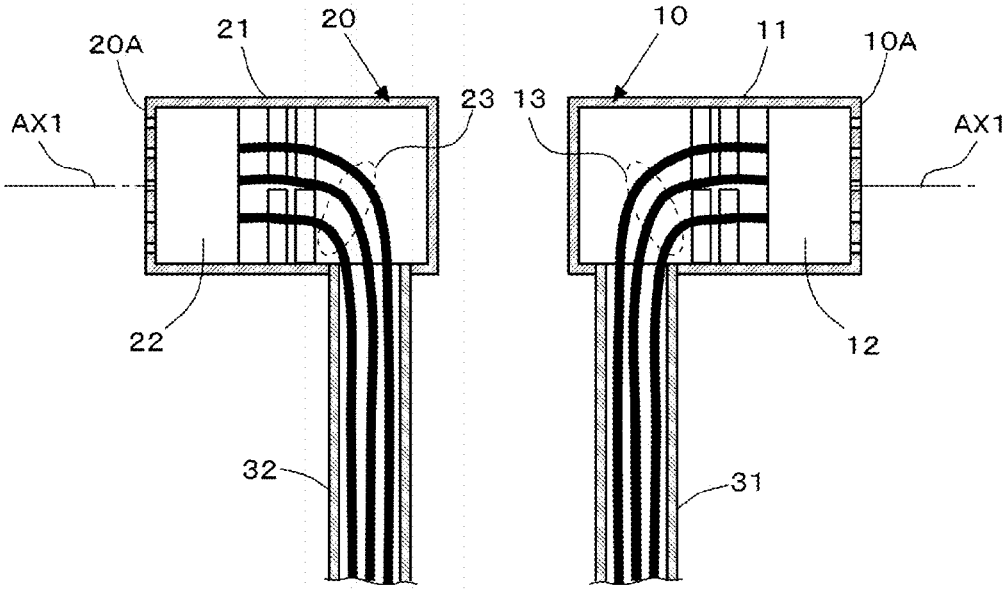
FIG. 5B is a partial cross-sectional view of FIG. 5A.

FIGS. 1A through 1D illustrate the stored state of the left and right microphones 10, 20. The left and right microphones 10, 20 in the present embodiment are arranged in a V shape in the stored state. The left and right microphones 10, 20 arranged in a V shape have an angle between sound pickup axes of them approximately from 60° to 120°. In this context, "a sound pickup axis" generally means a virtual axial line extending in an orthogonal direction from a surface of a diaphragm built in a microphone. The diaphragm vibrates upon receiving sound and transfers the vibration to an electric transducer system. FIGS. 5A, 5B illustrate sound pickup axes AX of the left and right microphones 10, 20. Inside the left and right microphones 10, 20, microphone capsules 12, 22 described later are placed. The microphone capsules 12, 22 are provided with respective diaphragms, not shown. Virtual axial lines extending in an orthogonal direction from the surface of these diaphragms are sound pickup axes AX1.

In the upper surface of the housing 101 of the present embodiment, two recesses 101*a*, 101*a* arranged in a V shape and corresponding to the shapes of the left and right microphones 10, 20 are formed. The left and right microphones 10, 20 in a stored state are stored in the two recesses 101*a*, 101*a* of the upper surface of the housing 101.

First Extended State

The microphone unit 1 in the present embodiment is provided with a lifting mechanism 40 described later. The lifting mechanism 40 is configured to vertically moving both the left and right microphones 10, 20 together. A rear plate 105 of the housing 101 illustrated in FIG. 1D is provided with a slide groove 41 and a slider 42 as partial components of the lifting mechanism 40. The slider 42 is capable of vertically moving along the slide groove 41. The linear motion for moving the slider 42 is transferred to both the left and right microphones 10, 20.

When the slider 42 illustrated in FIG. 1D is moved upwardly along the slide groove 41, the left and right microphones 10, 20 are in a first extended state illustrated in FIGS. 2A through 2D. The left and right microphones 10, 20 in the present embodiment are in the first extended state from the stored state, remaining being arranged in a V shape. The left and right microphones 10, 20 are joined respectively to left and right shafts 31, 32 configuring the retractable mechanism 30. The left and right shafts 31, 32 are arranged vertically in parallel. The left and right shafts 31, 32 have a structure rotatable about axes extending in the longitudinal direction. The left and right microphones 10, 20 are capable of horizontal rotation together with the left and right shafts 31, 32.

Second Extended State

As described above, the microphone unit 1 in the present embodiment is provided with the retractable mechanism 30 described later. The retractable mechanism 30 is configured to convert rotary motion of the left and right shafts 31, 32 to linear motion. When the left and right shafts 31, 32 are rotated horizontally, the retractable mechanism 30 moves the left and right shafts 31, 32 vertically. Due to such structure, when the left and right microphones 10, 20 joined respectively to the left and right shafts 31, 32 are rotated horizontally, they move vertically. Moreover, the retractable mechanism 30 in the present embodiment is configured, when a horizontal angle of the left and right microphones 10, 20 reaches an angle of sound pickup axes AX1 intersecting with each other, to differentiate vertical positions of the left and right microphones 10, 20.

In the first extended state illustrated in FIGS. 2A through 2D, the left and right microphones 10, 20 are rotated horizontally and arranged in an inverted V shape to be in a second extended state illustrated in FIGS. 3A through 3D. When the left and right microphones 10, 20 are arranged in an inverted V shape, the sound pickup axes AX1 intersect with each other at a predetermined angle. The angle of the sound pickup axes AX1 intersecting with each other ranges, for example, approximately from 90° to 135°. Further, in the second extended state, the left and right microphones 10, 20 are arranged to have front areas vertically overlapped with one another. At this point, the sound pickup surfaces 10A, 20A of the left and right microphones 10, 20 intersect with each other on a same vertical axial line (refer to an axial line AX2 in FIG. 4B). As a result, the left and right microphones 10, 20 in the second extended state satisfy all conditions related to the arrangement necessary for the true XY technique.

Retracting Movement of Left and Right Microphones

Figure 4A:
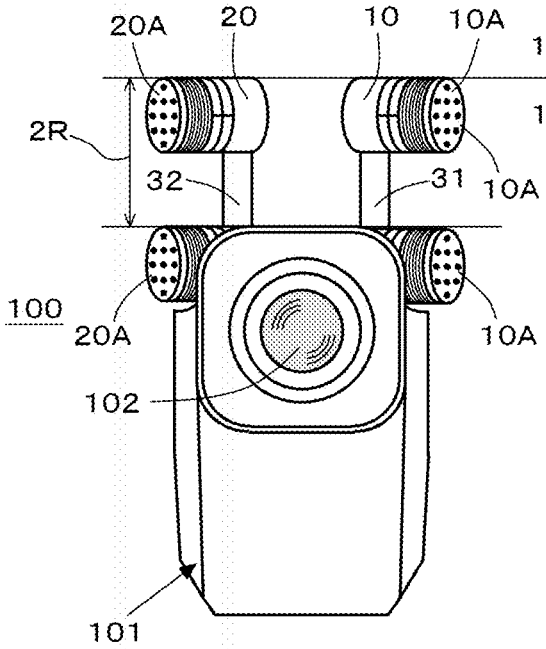
FIG. 4A is a front view illustrating retracting movement of the left and right microphones.
Figure 4B:
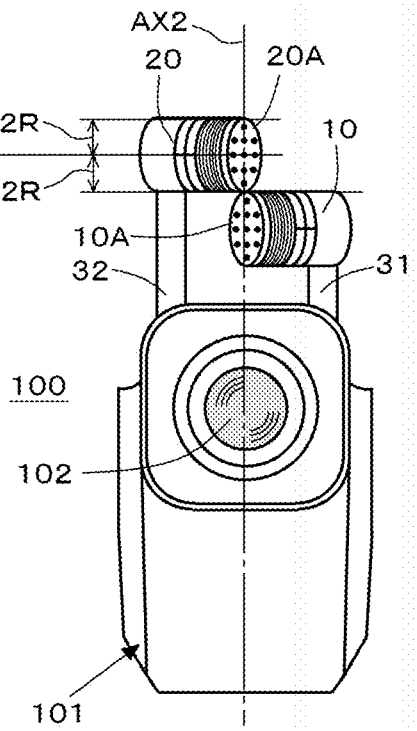
FIG. 4B is another front view illustrating retracting movement of the left and right microphones.

FIGS. 4A and 4B illustrate the left and right microphones 10, 20 in the stored state, the first extended state, and the second extended state. Descriptions are given below to retracting movement of the left and right microphones 10, 20, assuming that the left and right microphones 10, 20 illustrated in FIGS. 4A and 4B have a diameter of "R". Amounts of movement of the left and right microphones 10, 20 illustrated in FIG. 4A using "R" are merely examples for explanation. The microphone unit of the present invention has amounts of movement not limited to those exemplified in FIGS. 4A and 4B.

Switching between the stored state and the first extended state is performed by the lifting mechanism 40 described later. The lifting mechanism 40 vertically moves both the left and right microphones 10, 20 together. As illustrated in FIGS. 4A and 4B, when the stored state is changed to the first extended state, both the left and right microphones 10, 20 respectively move upwardly in the amount of 2R. The lifting mechanism 40 does not change the horizontal angle of the left and right microphones 10, 20. Accordingly, the left and right microphones 10, 20 remain in the arrangement in a V shape to be changed from the stored state to the first extended state. In contrast, when the first extended state is changed to the stored state, both the left and right microphones 10, 20 respectively move downwardly in the amount of 2R.

Then, switching between the first extended state and the second extended state is performed by the retractable mechanism 30 described later. The retractable mechanism 30 vertically moves the left and right microphones 10, 20 individually in accordance with the horizontal angle of the left and right microphones 10, 20. As described in FIGS. 4A and 4B, when the first extended state is changed to the second extended state, the left microphone 10 moves downwardly in the amount of ½R. Meanwhile, when the first extended state is changed to the second extended state, the right microphone 20 moves upwardly in the amount of ½R. The left and right microphones 10, 20 are thus arranged in an inverted V shape in the positions vertically different in the amount of R. At this point, the sound pickup surfaces 10A, 20A intersect with each other on the same vertical axial line AX2. Although not shown in FIGS. 4A and 4B, a minute clearance is actually secured between the left and right microphones 10, 20 in the second extended state.

Left and Right Microphones

As illustrated in FIGS. 5A and 5B, the left and right microphones 10, 20 in the present embodiment have the same structure. The left and right microphones 10, 20 are provided with cylindrical cases 11, 21. In the cases 11, 21, the unidirectional microphone capsules 12, 22 are stored. As described above, the front surfaces of the cases 11, 21 are the sound pickup surfaces 10A, 20A having a large number of holes formed therein.

The microphone capsules 12, 22 are arranged at the rear of the sound pickup surfaces 10A, 20A. In the microphone capsules 12, 22, a diaphragm and a field effect transistor (FET), not shown, are stored. At the front of the microphone capsules 12, 22, diaphragms are arranged. At the rear surfaces of the microphone capsules 12, 22, three electrodes corresponding to the source, the drain, and the ground of the FET are placed. In this context, the microphone capsules 12, 22 in the present embodiment employ a three wire system excellent in sound quality. The three electrodes of the FET are therefore connected to respective lead wires 13, 23. The lead wires 13, 23 pass through the respective left and right shafts 31, 32 and are connected to left and right audio input units, not shown, of the video recorder 100.

The diaphragms of the microphone capsules 12, 22 vibrate upon receiving the sound passing through the sound pickup surfaces 10A, 20A. The vibration of the diaphragm is converted to an electrical signal and input to the left and right audio input units of the video recorder 100 via the lead wires 13, 23 of the sources.

Retractable Mechanism

The retractable mechanism 30 in the present embodiment is illustrated in FIGS. 5A and 5B and FIGS. 6A through 6D. To vertically move the left and right microphones 10, 20 individually, the retractable mechanism 30 includes the left and right shafts 31, 32, four guide projections 31*a*, 32*a*, two shaft covers 33, and four guide grooves 33*a*.

In FIGS. 5A and 5B, both the left and right shafts 31, 32 are made from metal pipes. In lower portions from the center of the side surface of the left shaft 31, two guide projections 31*a*, 31*a* placed. The guide projections 31*a*, 31*a* in the present embodiment are configured with both ends of one metal pin. The metal pin horizontally penetrates a side surface of the left shaft 31. Accordingly, the two guide projections 31*a*, 31*a* are placed in vertically same positions in the side surface of the left shaft 31. Similarly, in lower portions of a side surface of the right shaft 32, two guide projections 32*a*, 32*a* are placed. The guide projections 32*a*, 32*a* are also is configured with both ends of one metal pin that horizontally penetrates the side surface of the right shaft 32.

In this description, the left and right guide projections 31*a*, 32*a* are in vertical positions different from each other. In accordance with the example in FIGS. 4A and 4B, the positions of the left and right guide projections 31*a*, 32*a* are vertically different from each other in the amount of ½R.

Figure 6A:
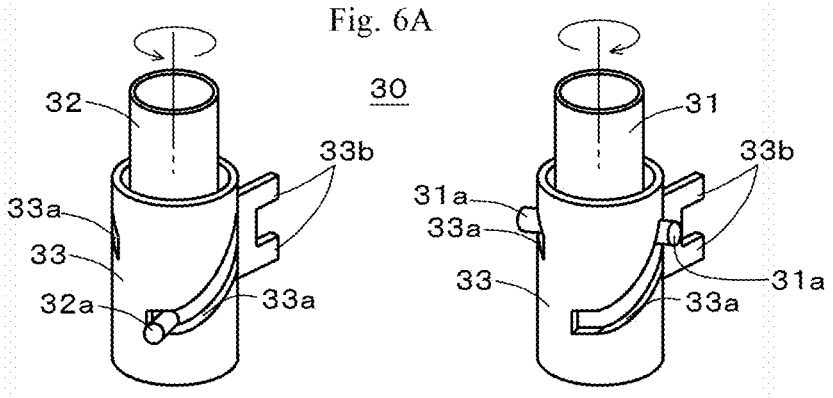
FIG. 6A is a perspective view illustrating a retractable mechanism of the left and right microphones.

As illustrated in FIG. 6A, areas provided with the guide projections 31*a*, 32*a* in the side surfaces of the left and right shafts 31, 32 are covered with shaft covers 33, 33. The left and right shaft covers 33, 33 have the very same structure.

The shaft covers 33 are configured with cylindrical walls having a diameter greater than those of the left and right shafts 31, 32. The walls are provided with a pair of facing guide grooves 33*a*, 33*a*. The pair of guide grooves 33*a*, 33*a* have the very same shape. Main portion of the guide grooves 33*a* is inclined grooves extending vertically along the cylindrical walls. An upper end and a lower end of the inclined groove continue respectively to short grooves extending horizontally. In accordance with the example in FIGS. 4A and 4B, the upper end and the lower end of the guide grooves 33*a* have a difference in height vertically in the amount of ½R.

In the pair of guide grooves 33*a*, 33*a*, the two guide projections 31*a*, 31*a* or 32*a*, 32*a* are locked, respectively. The shaft covers 33 are fixed to the lifting mechanism 40 described later by coupling projections 33*b* provided on the walls. By such structure, the guide projections 31*a*, 32*a* vertically move along the guide grooves 33*a* with rotation of the left and right shafts 31, 32. In other words, rotary motion of the left and right shafts 31, 32 is converted to vertical linear motion.

Here, FIG. 6A illustrates the stored state and the first extended state described above, that is, a state where the left and right microphones 10, 20 are arranged in a V shape. The arrangement of the left and right microphones 10, 20 is switched from a V shape to an inverted V shaped by a structure described below.

In FIG. 6A, the guide projections 31*a* of the left shaft 31 are positioned at the upper end of the guide grooves 33*a*. The left shaft 31 is, therefore, capable of rotating only clockwise in the drawing in accordance with the guide grooves 33*a*. The left shaft 31 having rotated clockwise moves downwardly in the amount of ½R, which is the difference in height of the guide grooves 33*a*.

Meanwhile, in FIG. 6A, the guide projections 32*a* of the right shaft 32 are positioned at the lower end of the guide grooves 33*a*. The right shaft 32 is, therefore, capable of rotating only counterclockwise. The right shaft 32 having rotated counterclockwise moves upwardly in the amount of ½R, which is the difference in height of the guide grooves 33*a*.

By the structure described above, the left and right microphones 10, 20 are arranged in an inverted V shape in the positions vertically different in the amount of R (refer to FIG. 4B).

Figure 6B:
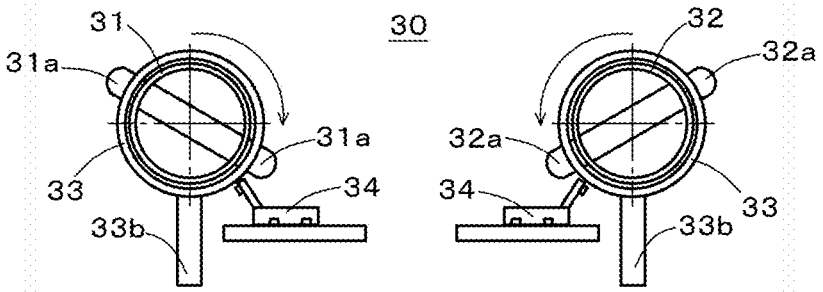
FIGS. 6B through 6D are cross-sectional plan views illustrating the retractable mechanism where the left and right microphones are transferred from an arrangement in a V shape to an arrangement in an inversed V shape.
Figure 6C:
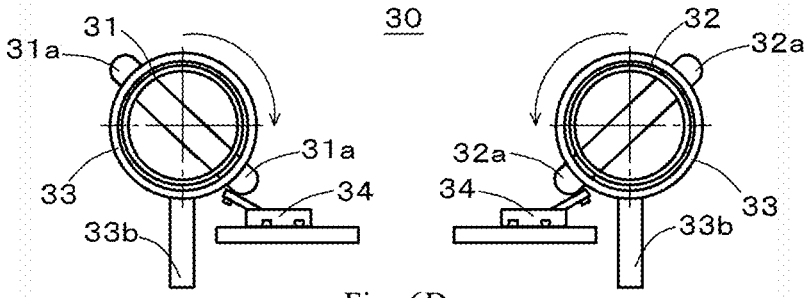
Figure 6D:
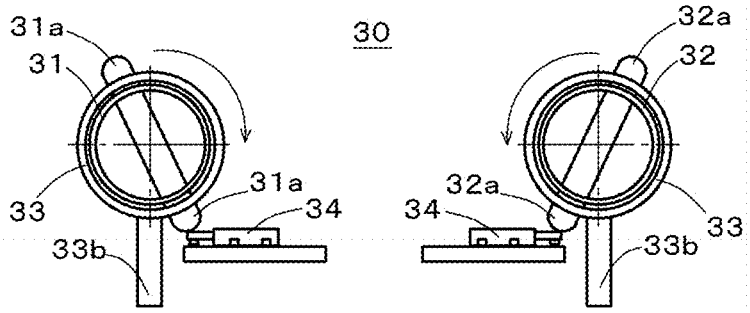
Figure 7A:
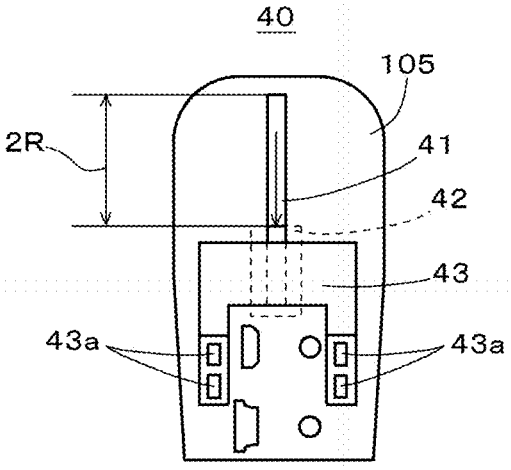
FIG. 7A is a front view illustrating a lifting mechanism in the stored state of the left and right microphones.
Figure 7B:
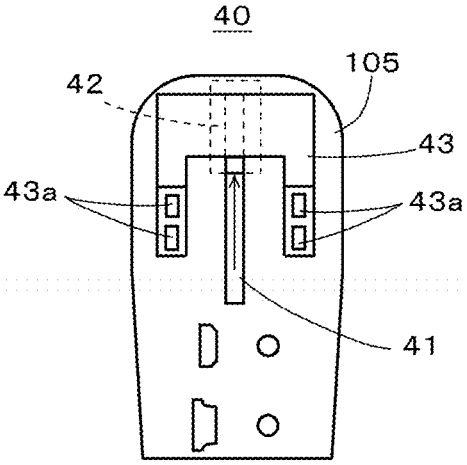
FIG. 7B is a front view illustrating the lifting mechanism in the first extended state of the left and right microphones.
Figure 7C:
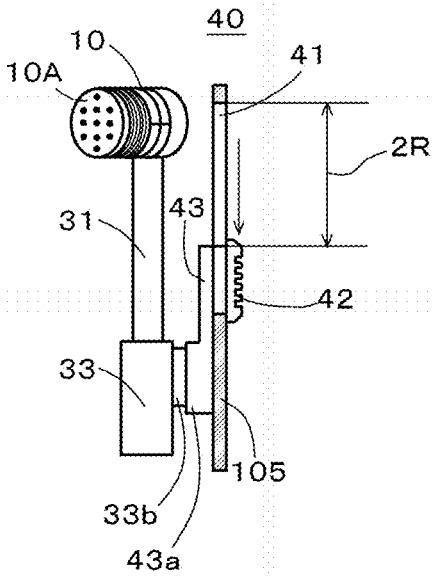
FIG. 7C is a cross-sectional side view illustrating the lifting mechanism in the stored state of the left and right microphones.
Figure 7D:
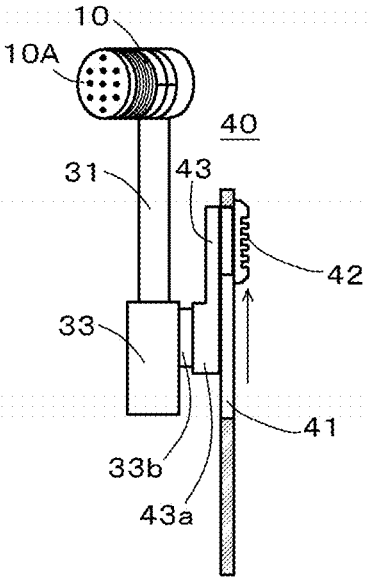
FIG. 7D is a cross-sectional side view illustrating the lifting mechanism in the first extended state of the left and right microphones.

Here, as illustrated in FIGS. 6B through 6D, the retractable mechanism 30 in the present embodiment includes left and right switches 34, 34 to detect arrangements of the left and right microphones 10, 20. The left and right switches 34, 34 have the very same structure while being different in the arrangement relative to the guide grooves 33*a* of the shaft covers 33. The switch 34 corresponding to the left shaft 31 is arranged near the lower end of the guide groove 33*a*. The switch 34 corresponding to the right shaft 32 is arranged near the upper end of the guide groove 33*a*. When the left and right microphones 10, 20 are arranged in an inverted V shape, the left and right guide projections 31*a*, 32*a* turn ON the two switches 34, 34 (refer to FIG. 6D).

When both the two switches 34, 34 are turned ON, a processor built in the video recorder 100 switches the left and right audio inputs of the left and right microphones 10, 20. That is, while the left and right microphones 10, 20 are arranged in an inverted V shape, the processor processes a signal from the left microphone 10 as a right audio input and processes a signal from the right microphone 20 as a left audio input.

Lifting Mechanism

The microphone unit 1 in the present embodiment is provided with the lifting mechanism 40 illustrated in FIG. 7A through D. The lifting mechanism 40 includes a slide groove 41, a slider 42, and a lifting plate 43. These components of the lifting mechanism 40 are placed in the rear plate 105 of the housing 101.

The slide groove 41 is a linear groove formed vertically in the rear plate 105. The slider 42 is slidably mounted to the slide groove 41 from the front side of the rear plate 105. The slider 42 is joined to the lifting plate 43 arranged on the back side of the rear plate 105. The lifting plate 43 has a pair of coupling recesses 43*a*, 43*a*. The coupling recesses 43*a*, 43*a* are fixed to the coupling projections 33*b* of the two shaft covers 33 configuring the retractable mechanism 30.

In accordance with the example in FIGS. 4A and 4B, the slide groove 41 has a length adding 2R to the vertical length of the slider 42. The slider 42 is capable of vertically moving in the amount of 2R along the slide groove 41. The lifting plate 43 vertically moves in the amount of 2R with the movement of the slider 42. The left and right shafts 31, 32 mounted to the lifting plate 43 also move vertically in the amount of 2R with the movement of the slider 42. The lifting mechanism 40 in such structure enables switching of the left and right microphones 10, 20 between the stored state and the first extended state.

Technical Effects

The microphone unit 1 in the present embodiment described above exhibits the following technical effects.

Firstly, the retractable mechanism 30 enables switching of an arrangement of left and right microphones 10, 20 between an inverted V shaped arrangement as a true XY technique and a V shaped arrangement. That is, when the left and right microphones 10, 20 are arranged in an inverted V shape, the retractable mechanism 30 differentiates vertical positions of the left and right microphones 10, 20. At this point, front side areas of the left and right microphones 10, 20 are arranged in vertical overlap and the sound pickup surfaces 10A, 20A intersect with each other on the same vertical axial line AX2. The arrangement of the left and right microphones 10, 20 is thus in a true XY technique. Meanwhile, when a horizontal angle between the left and right microphones 10, 20 are arranged in a V shape, the retractable mechanism 30 equalizes the vertical positions of the left and right microphones 10, 20. In such a manner, the microphone unit 1 in the present embodiment is capable of achieving both the inverted V shaped arrangement as a true XY technique and the V shaped arrangement.

Secondly, when the left and right microphones 10, 20 are arranged in a true XY technique, they provide high recording quality. That is, when the left and right microphones 10, 20 are in an inverted V shaped arrangement, they are arranged in different vertical positions and the sound pickup surfaces 10A, 20A intersect with each other on the same vertical axial line AX2. The arrangement of recorded sound is thus expressed, in addition to in left and right directions, in a near and far direction as well. In addition, such arrangement allows good recording of sound from the front.

Thirdly, even when the left and right microphones 10, 20 are stored in the housing 101, they provide good recording quality. That is, when the left and right microphones 10, 20 are in a state of being extended from the housing 101, they are in a true XY technique arrangement. Meanwhile, when the left and right microphones 10, 20 are in a state of being stored in the housing 101, they are in a V shaped arrangement. Accordingly, the left and right microphones 10, 20 provide good recording quality based on different techniques in both the stored state and the extended state.

The microphone unit of the present invention is not limited to the embodiments described above and various modifications in the structure are available. For example, the arrangement of the left and right microphones in the stored state is not limited to a V shaped arrangement. For example, the left and right microphones may have a structure to be arranged in parallel in the stored state. In addition, the retractable mechanism and the lifting mechanism are not limited to the illustrated structures. Moreover, the microphone unit of the present invention is not limited to a video recorder and is applicable to, for example, an audio recorder, an external microphone, and the like.

REFERENCE SIGNS LIST

1 microphone unit
10 left microphone
20 right microphone
10A, 20A sound pickup surface
11, 21 case
12, 22 microphone capsule
13, 23 signal wire
30 retractable mechanism
31 left shaft
32 right shaft
31*a*, 32*a* guide projection
33 shaft cover
33*a* guide groove
33*b* coupling projection
34 switch
40 lifting mechanism
41 slide groove
42 slider
43 lifting plate

43*a* coupling recess
100 video recorder
101*a* recess
102 lens
103 display unit
104 operation unit
104*a* power switch
104*b* image recording switch
104*c* input volume dial
105 rear plate
105*a* HDMI terminal hole
105*b* USB terminal hole
105*c* external input terminal hole
105*d* headphone terminal hole
AX1 sound pickup axis
AX2 vertical axial line

The invention claimed is:

1. A microphone unit for stereo recording, comprising:

a pair of unidirectional left and right microphones; and a retractable mechanism joined to the respective left and right microphones, wherein the retractable mechanism is configured to allow change in a horizontal angle and a vertical position of each of the left and right microphones, when the horizontal angle of the left and right microphones reaches an angle of sound pickup axes of the microphones intersecting with each other, to differentiate the vertical positions of the left and right microphones and thus to arrange at least part of the left and right microphones in vertical overlap, and when the horizontal angle of the left and right microphones reaches an angle of the sound pickup axes not intersecting with each other, to equalize the vertical positions of the left and right microphones.

2. The microphone unit for stereo recording according to claim 1, wherein, when at least part of the left and right microphones is arranged in vertical overlap, sound pickup surfaces of the left and right microphones intersect with each other on a same vertical axial line.

3. The microphone unit for stereo recording according to claim 1, wherein an angle between the respective intersecting sound pickup axes ranges approximately from 90° to 135°.

4. The microphone unit for stereo recording according to claim 1, wherein, when a vertical reference position is assumed, a case where the vertical positions of the left and right microphones are in the reference position is defined as a stored state, and a case where the vertical positions of the left and right microphones are above the reference position is defined as an extended state, the retractable mechanism is configured to equalize the vertical positions of the left and right microphones in the stored state and to differentiate the vertical positions of the left and right microphones in the extended state.

5. The microphone unit for stereo recording according to claim 1, wherein the retractable mechanism includes:

a pair of shafts joined to the respective left and right microphones and extending vertically;

a pair of guide grooves placed in a wall of each shaft or a wall of another member surrounding each shaft; and a pair of guide projections locked in the respective guide grooves, and at least part of the guide grooves is configured to be inclined for interconversion between rotation and vertical motion of the shaft.

6. The microphone unit for stereo recording according to claim 5, wherein the retractable mechanism further includes a lifting mechanism, causing vertical motion of at least each shaft.

* * * * *